United States Patent [19]

Ellington

[11] Patent Number: 4,913,439

[45] Date of Patent: Apr. 3, 1990

[54] GOLF PRACTICE NET APPARATUS

[75] Inventor: Carroll M. Ellington, Charlotte, N.C.

[73] Assignee: Performance Golf Products, Inc., Charlotte, N.C.

[21] Appl. No.: 353,958

[22] Filed: May 19, 1989

[51] Int. Cl.[4] ..... A63B 69/36

[52] U.S. Cl. ..... 273/181 F; 206/315.1; 206/407

[58] Field of Search ..... 273/181 F, 181 R, 181 A, 273/181 E, 181 G, 181 H, 181 K, 182 R, 182 A, 400, 401, 402, 395, 26 A, 407

[56] References Cited

U.S. PATENT DOCUMENTS

| | | | |
|---|---|---|---|
| 574,087 | 12/1896 | Frick | 273/402 |
| 2,915,314 | 12/1959 | Phillips | 273/26 A |
| 3,001,795 | 9/1961 | Johnson, Jr. | 273/181 F |
| 3,013,801 | 12/1961 | Kirkconnell, Jr. | 273/181 F |
| 3,043,592 | 7/1962 | Lohr | 273/395 |
| 3,197,208 | 7/1965 | Makar | 273/181 F |
| 3,583,703 | 6/1971 | Brown | 273/26 A |
| 3,758,116 | 9/1973 | Pieronek | 273/181 A |
| 3,986,719 | 10/1976 | Lee | 273/181 F |
| 4,063,739 | 12/1977 | LaRose | 273/181 F |
| 4,523,760 | 6/1985 | Bednarczuk | 273/181 F |

FOREIGN PATENT DOCUMENTS

| | | | |
|---|---|---|---|
| 2847701 | 5/1980 | Fed. Rep. of Germany | 273/400 |

*Primary Examiner*—George J. Marlo
*Attorney, Agent, or Firm*—Shefte, Pinckney & Sawyer

[57] ABSTRACT

A golf practice net apparatus which includes an elongate cross-member having arm portions pivotable between a deployed position in which the arm portions are aligned with one another and a storage position in which the arm portions are in adjacent, generally facing abutment to one another. A net is secured along both arm portions of the elongate cross-member and is folded and unfolded in response to pivotal movement of the arm portions between the deployed and the stored positions of the cross-member. The cross-member is mounted on a pair of spaced apart support assemblies formed of assemblable and disassemblable components.

7 Claims, 3 Drawing Sheets

FIG. 1
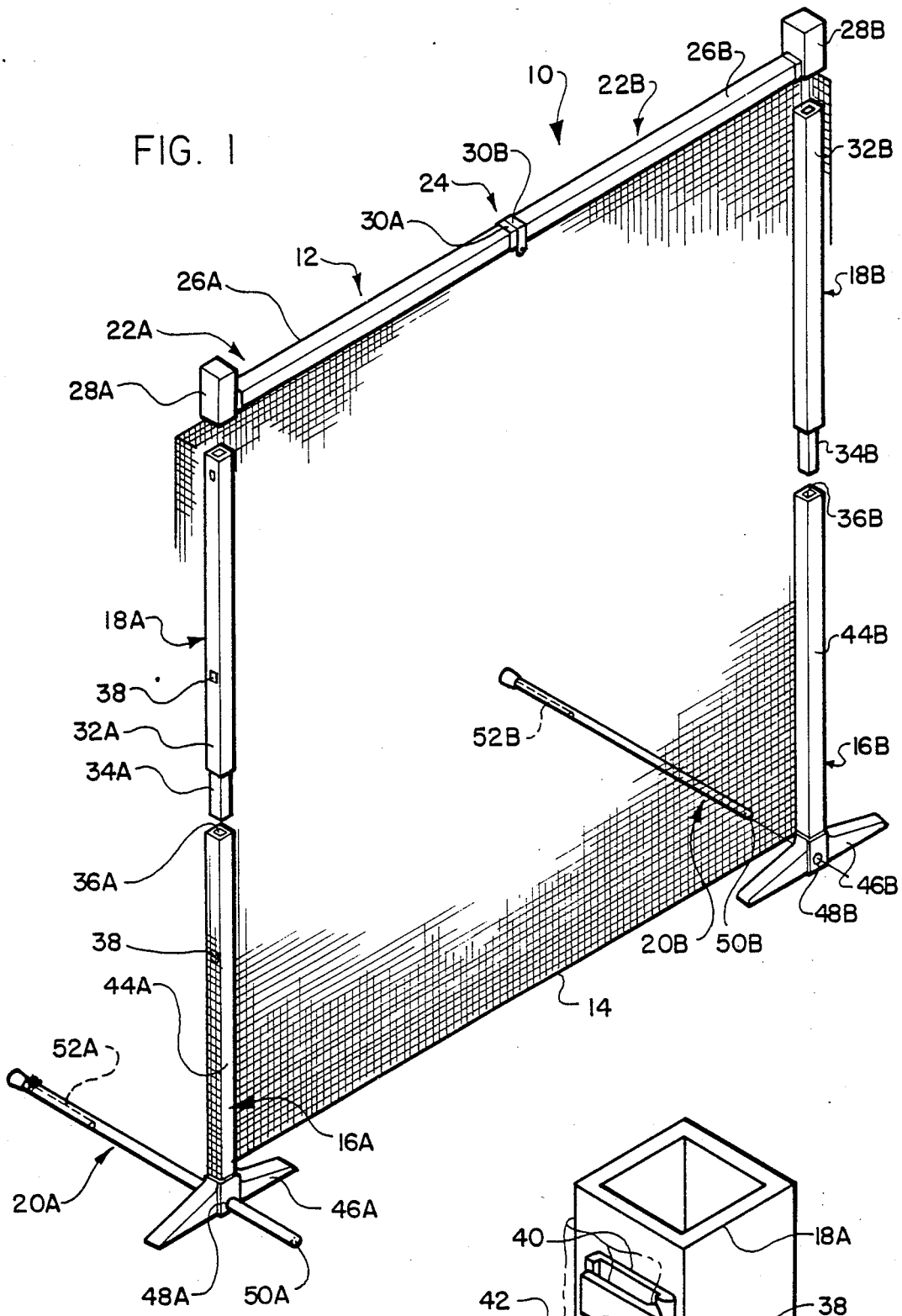
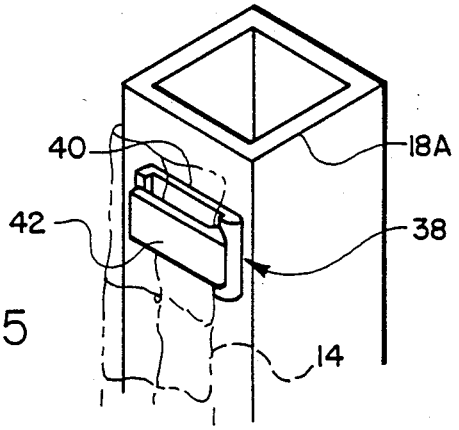
FIG. 5

GOLF PRACTICE NET APPARATUS

BACKGROUND OF THE INVENTION

The present invention relates to a golf practice net apparatus and, more particularly, to an easily assemblable and disassemblable golf practice net apparatus.

While actually played on a course extending over many acres, the game of golf readily lends itself to practice within relatively limited areas since the golfer requires only sufficient room to fully swing a golf club. Moreover, to more closely simulate the actual playing conditions during practice, the golfer can practice by swinging normally and driving or hitting an actual golf ball into a net or other appropriate ball restraining means positioned a few feet from the golfer. To this end, a number of portable golf practice net structures have been proposed, representative examples of which are disclosed in U.S. Pat. Nos. 3,001,795; 3,013,801; 3,197,208; 3,758,116; 3,986,719; 4,063,739 and 4,523,760.

However, these known golf practice net structures do not fully realize the benefits of ease of assembly and disassembly and ease of storage through reduced dimensions. For example, in U.S. Pat. No. 4,523,760 to Bednarczuk, the golfer must pass a lacing member such as a lace or a cord through facing portions of the net to secure the net to the net frame and this securement method is understandably time-consuming and somewhat exacting. Likewise, in U.S. Pat. No. 4,063,739 to La Rose, although the deployment and storage of the net is somewhat facilitated by providing the capability to simply wrap the net about one of the net frame members, no capability is provided for reducing the elongate dimension of the net in its storage position so that carrying and storage of the disassembled golf net apparatus is hindered by the need to accommodate the uncollapsed elongate extent of the net.

Accordingly, the need exists for a golf practice net apparatus which allows the golfer to easily and rapidly assemble the apparatus and which significantly reduces the overall dimensions of the apparatus in its storage disposition.

SUMMARY OF THE INVENTION

The present invention provides a golf practice net apparatus which allows the golfer to easily and rapidly assemble and disassemble the apparatus and which significantly reduces the overall dimensions of the apparatus in its disassembled storage disposition.

Broadly, the golf practice net apparatus according to the present invention basically includes a net, a pair of support means, each positionable in a generally upright disposition at a spacing from one another, and a cross-member selectively connectible to the support means in their generally upright disposition to extend therebetween. The net is connected to the cross-member and the cross-member has a pair of arm portions selectively movable relative to one another between a generally aligned orientation when connected to the support means and an adjacent facing relation with one another to effect folding of the cross-member and the net as a unit when disconnected from the support means permitting wrapping of the net about the cross-member for storage.

Preferably, the golf practice net apparatus includes a pair of support members, a cross-member, a net, a pair of extension members and a pair of stabilizer members. The cross-member has a pair of elongate arm portions movably interconnected to one another for selective movement between a deployed position in which the arm portions are oriented in general alignment to one another and a storage position in which the arm portions are oriented in adjacent, generally facing relation to one another. The net is secured to the cross-member for movement therewith between its deployed and storage positions.

Each support member has an elongate leg portion and a foot portion mounted at one end of the leg portion and extending generally transversely thereto, the leg portion having a longitudinally extending interior storage cavity. Additionally, each support member includes means for connecting and disconnecting the net thereto. One end of each extension member is connectible to and disconnectible from the leg portion of a respective one of the support members and the other end of each extension member is connectible to and disconnectible from a respective arm portion of the cross-member. Additionally, each extension member includes means for connecting and disconnecting the net thereto. Each stabilizer member is of an elongate configuration which is selectively connectible to a respective one of the support members for supporting the support member in a generally upright disposition and the cross-member in a generally horizontal disposition and disconnectible from the respective storage member for insertion into the cavity of its associated support member for storage. The support members, the cross-member, the net and the stabilizer members are thus assemblable to deploy the net in a generally upright fully extended disposition for retarding the speed of a golf ball propelled thereagainst and are disassemblable into a relatively compact, and carryable arrangement.

In the preferred embodiment, the arm portions of the cross-member are interconnected to one another by a hinge for pivotal folding movement, and the net is secured to the cross-member along both arm portions. It is also preferred that clips or the like be utilized as the means for connecting and disconnecting the net to and from the extension members and the support members.

Each stabilizer member is preferably connectible to its respective support member at the foot portion thereof and includes a weight means secured adjacent one end thereof to be disposed outwardly from the respective support member when connected thereto.

BRIEF DESCRIPTION OF THE DRAWINGS

FIG. 1 is a partially-exploded perspective view of one preferred embodiment of the golf practice net apparatus of the present invention in its deployed disposition.

FIG. 5 is an enlarged perspective view of a net retaining clip of the apparatus of the present invention.

DETAILED DESCRIPTION OF THE PREFERRED EMBODIMENT

Figure 2A:
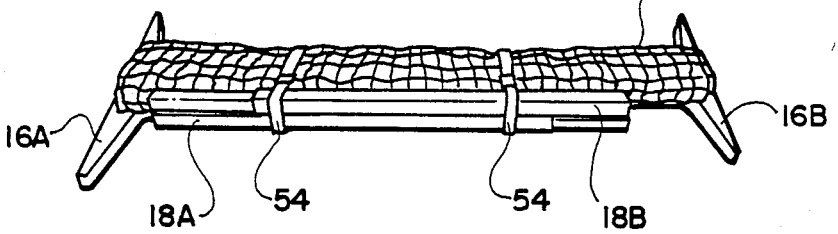
FIG. 2A is a perspective view of the golf practice net apparatus shown in FIG. 1 in its storage position.

In FIGS. 1–5, one preferred embodiment of the golf practice net apparatus of the present invention is illustrated and is generally designated as 10. The golf practice net assembly 10 is adapted to be easily assembled by a golfer into its deployed disposition, in which it is positioned several feet from the golfer for retarding or braking the movement of a golf ball propelled thereaginst, and easily disassembled into a compact storage disposition, in which the apparatus can be easily accommodated in a wide range of storage locations, such as the trunk or back seat of an automobile.

The golf practice net apparatus 10 basically includes an elongate cross-member 12, a net 14 secured by straps, clips or other appropriate securement means (not shown) to the elongate cross-member 12, a pair of support members 16A and 16B, a pair of extension members 18A and 18B, and a pair of elongate stabilizer members 20A and 20B. The elongate cross-member 12 includes a pair of arm portions 22A,22B of identical configuration which are interconnected to one another by a hinge 24. Each arm portion 22A,22B includes an elongate, parallelepiped segment 26A,26B, respectively, and a hollow parallelepiped cap 28A,28B, respectively, formed at one end of its respective elongate, parallelepiped segment.

The hinge 24 includes a pair of brackets 30A,30B pivotably connected to one another and rigidly affixed, respectively, to facing ends of the arm portions 22A,22B of the cross-member 12. The brackets 30A,30B are oriented relative to one another such that they pivot about their hinge connection along an axis generally transverse to the longitudinal extent of the elongate segments 26A,26B. Accordingly, the arm portions 22A,22B are movable relative to one another by pivoting about the hinge axis in a direction to decrease the included angle X therebetween until the arm portions ultimately rest adjacent, generally facing abutment to one another, as best shown by the broken line illustration of the arm portion 22B and the solid line illustration of the arm portion 22A in FIG. 3. Likewise, the arm portions 22A,22B are movable relative to one another by pivoting about the hinge 24 to increase the included angle X therebetween until the portions are ultimately brought into substantial colinear relation with one another such as shown, for example, in FIG. 1, wherein the hinge brackets 30A,30B abut one another to maintain alignment of the arm portions 22A,22B.

The net 14 preferably comprises a substantially rectangular section of a conventional netting material fabricated of rope or twine extending in perpendicularly intersecting lengths tied together at the intersections, although substantially any conventional netting or fabric of suitable strength may be used. One lengthwise edge of the net 14 is secured as aforementioned to the cross-member 12 along substantially the full length of each arm portion 22A,22B.

Each support member 16A,16B includes an elongate leg portion 44A,44B, respectively, and a foot portion 46A,46B, respectively, mounted at one end of the respective elongate leg portion 44A,44B generally transversely thereto to provide a relatively stable base for supporting the support members in a generally upright manner. The leg portion 44A,44B of each support member 16A,16B is of a substantially parallelepiped cross-section and is hollow from its end opposite the foot portion 46A,46B through the predominant extent of the length of the leg portion 44A,44B, as indicated at 36A,36B. Additionally, the support members 16A,16B each include a plurality of net retaining clips 38 secured by adhesive or other appropriate securement means to one longitudinal side of the respective leg portion 44A,44B thereof for securing the net 14 to the support members. A cylindrical bore 48A,48B is formed through each respective foot portion 46A,46B for receiving the elongate stabilizer members 20A,20B, respectively, inserted therethrough.

The extension members 18A,18B each include an elongate body portion 32A,32B, respectively, of generally parallelepiped shape and an insert portion 34A,34B, respectively, formed at one end of the respective body portion of the extension member. Each insert portion 34A,34B is of the same generally parallelepiped shape as, but of slightly smaller dimensions than, the respective body portion 32A,32B of the extension members 18A,18B and is configured for generally snug insertion into the longitudinally extending interior cavities 36A,36B respectively formed in the hollow leg portions 44A,44B for supporting the extension members 18A,18B in a fixed, upright disposition colinear with the respective leg portions 44A,44B of the support members 16A,16B. Similarly, the parallelepiped configuration of the body portions 32A,32B is adapted to snugly fit within the hollow interiors of the respective caps 28A,28B of the cross-member 12 for securing the cross-member 12 to the extension members 18A,18B to extend horizontally therebetween. Each extension member 18A,18B also includes a plurality of the net retaining clips 38 secured by adhesive or other appropriate securement means to one longitudinal side of its respective body portion 32A,32B.

As best seen in FIG. 5, each net retaining clip 38 includes a generally rectangular base portion 40 secured to its respective support or extension member and an integrally formed resilient tongue portion 42 flexibly connected at one end to the base portion 40. The net 14 is secured to the net retaining clips 38 by insertion of a strand of the net 14 through the open end of the tongue 42 of each clip into the region between the tongue 42 and the base portion 40 of the clip. The clips 38 are oriented on the support and extension members such that the open ends of their tongues 42 face the forward side of the apparatus 10 toward a golfer using the apparatus so that the impact of golf balls against the net serves to maintain the net seated in the clips 38.

The stabilizer members 20A,20B are each formed of an elongate, generally cylindrical, tubular configuration with a rounded closed end 50A,50B, respectively, and an opposite open end within which a relative heavier cylindrical tube, bar or the like, indicated at 52A,52B, respectively, is affixed to provide additional weighting of each stabilizer member 20A,20B at such end.

The golf practice net apparatus 10 additionally includes a pair of storage straps 54, preferably fabricated with a conventional Velcro material, for maintaining the components of the apparatus together with one another when disassembled during transport and storage thereof. Additionally, the straps 54 may be attached end-to-end to one another and looped at each end of the combined straps 54 through the net material at the center of the net 14 when the apparatus 10 is displayed as in FIG. 1, to provide a vertically extending target line for the golfer.

Figure 2B:
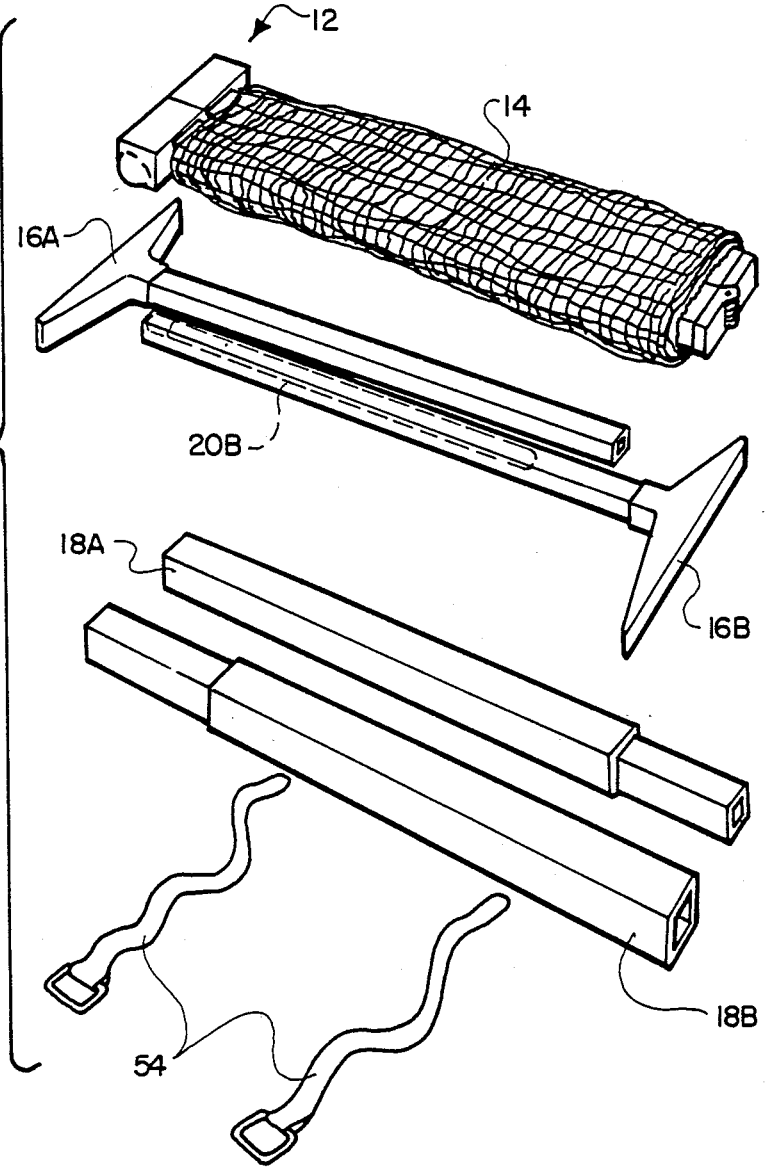
FIG. 2B is an exploded perspective view of the golf practice net apparatus shown in FIG. 2A.
Figure 3:
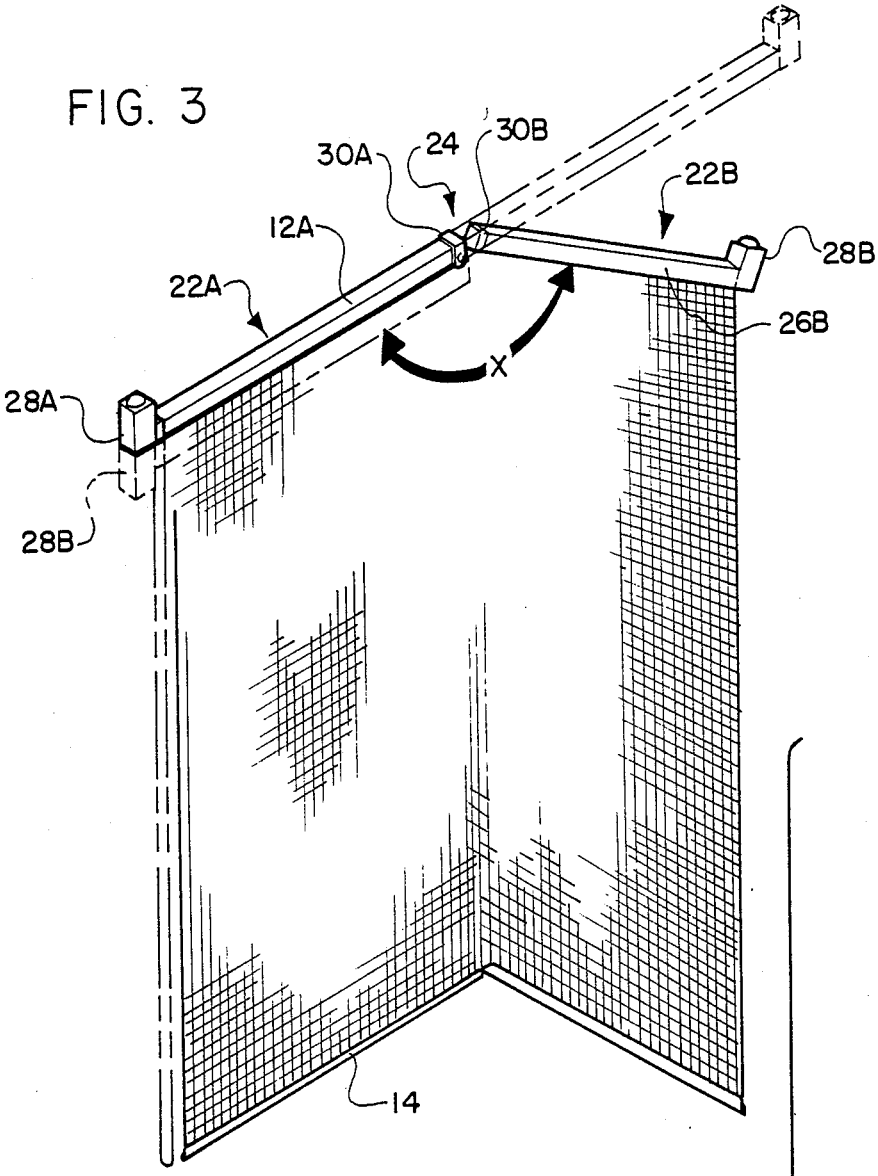
FIG. 3 is a perspective view of the cross-member and the net of the golf practice net apparatus shown in FIGS. 1, 2A and 2B.
Figure 4:
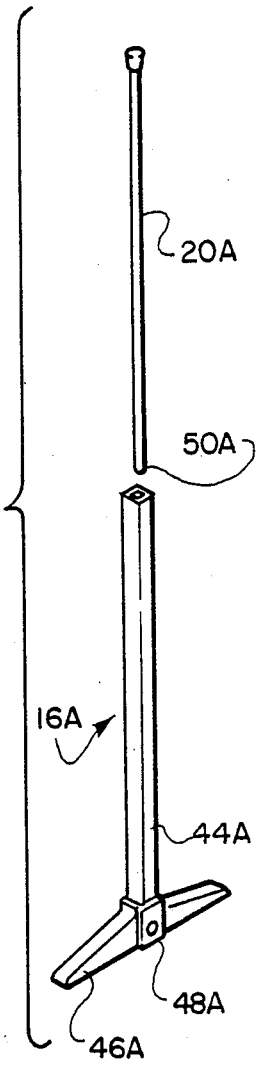
FIG. 4 is a perspective view of one of the elongate stabilizer members of the golf practice net apparatus of the present invention positioned for insertion into one of the support members of the apparatus for storage therein.

As can thus be understood, the golf practice net apparatus 10 is assemblable into a deployed position in which the net 14 presents a target and a golf ball retaining structure to the golfer and is disassemblable into a relatively compact, easily carryable storage configuration which the golfer can easily carry between a residence or an automobile and any suitable practice area, such as a grass area. As best shown in FIGS. 2A and 2B, the golf practice net apparatus 10 in its storage disposition is arranged such that the arm portions 22A,22B of the cross-member 12 are in adjacent, facing abutment with one another with the net 14 folded generally in half with respect to its widthwise extent generally parallel to the longitudinal extent of the cross-member 12 and with the net 14 wrapped or rolled around the abutting arm portions 22A,22B. The support members 16A,16B are likewise disposed in generally adjacent, facing abutment to one another with their respective base portions 46A,46B oppositely disposed and the extension members 18A,18B are disposed in adjacent, facing abutment to one another. The elongate stabilizer members 20A,20B are fully inserted in the respective cavities 36A,36B of the support members 16A,16B. Finally, the cross-member 12, with the net 14 wrapped thereabout, the leg members 16A,16B and the extension members 18A,18B are disposed in generally parallel, superposed abutment on one another and the straps 54 are secured about the superposed components of the golf practice net apparatus 10 at a spacing therealong.

To assemble the golf practice net apparatus 10 from its storage disposition of FIG. 2A into its deployed disposition of FIG. 1, the straps 54 are uncinched and the cross-member 12 with the net 14 wrapped thereabout, the support members 16A,16B and the extension member 18A,18B are separated from one another. Additionally, the stabilizer members 20A,20B are removed from the cavities of the support members 16A,16B and are inserted by their rounded closed ends 50A,50B into the respective cylindrical bores 48A,48B of the support members 16A,16B such that the rounded closed ends 50A,50B extend slightly forwardly beyond the support members. The support members 16A,16B are disposed in spaced apart position a distance corresponding to the extended length of the cross-member 12 and the extension members 18A,18B are inserted into their associated support members with the net-retaining clip side corresponding with the net retaining clip side of the support members 16A,16B. Preferably, the net retaining clips 38 are disposed on outward opposite sides of the support members and their associated extension members. Thereafter, the net is unrolled from the cross-member 12 and the arm portions 22A,22B of the cross-member 12 are pivoted about the hinge 24 until the arm portions 22A,22B have been brought into substantial alignment with one another wherein the hinge brackets 30A,30B abut one another and the pivoting action simultaneously unfolds the net 14 to extend it to its full extent. The fully extended cross-member 12 is then mounted on the pair of spaced apart extension members 18A,18B by press-fitting of the caps 28A,28B onto their respective extension members. The sides of the net 14 are then secured to the net retaining clips 38 on the extension members 18A,18B and the support members 16A,16B.

The present golf practice net apparatus thus provides a number of distinct advantages. As just described, the apparatus is readily assemblable and disassemblable with minimal effort and time required from the very compact package of components shown in FIGS. 2A, 2B to the fully erected apparatus of FIG. 1. By the novel construction of the individual components of the present apparatus, its overall dimensions when disassembled are in the range of 4' to 5' in length, 1' to 2' in width and only a matter of inches in height. Preferably, the individual components are fabricated of a lightweight plastic material, such as polyvinyl chloride, so that the overall weight of the apparatus when disassembled may be in the range of 20 to 25 pounds. Accordingly, the apparatus is easily portable from one location to another. Further, in its deployed disposition, the golf practice apparatus presents a stable structure supporting a net of substantial extent for retarding and ultimately stopping the progress of a golf ball hit thereagainst by a golfer. The foot portions 46A,46B of the support members 16A,16B, together with the stabilizer members 20A,20B substantially maintain the apparatus stationary in its deployed position against any undesired movement.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A golf practice net apparatus, comprising:

a cross-member having a pair of elongate arm portions movably interconnected to one another for selective movement between a deployed position in which said arm portions are oriented in general alignment to one another and a storage position in which said arm portions are oriented in adjacent, generally facing relation to one another;

a net secured to said cross-member for movement therewith between the deployed and storage positions;

a pair of upright support members, each support member having an elongate leg portion and a foot portion mounted at one end of said leg portion and extending generally transversely thereto, and each support member including means for connecting and disconnecting said net thereto, a pair of leg extension members, one end of each extension member being connectible to and disconnectible from the leg portion of a respective one of said support members and the other end of each extension member being connectible to and disconnectible from a respective arm portion of said cross-member, each extension member having means for connecting and disconnecting said net thereto; and a pair of elongate stabilizer members, each said stabilizer member being selectively connectible to a respective one of said support members for supporting the support member in a generally upright disposition and said cross-member in a generally horizontal disposition, and each said stabilizer member being selectively disconnectible from the respective support member, whereby said support members, said cross-member, said net and said stabilizer members are assemblable together to deploy said net in a generally upright fully extended disposition for retarding the speed of a golf ball propelled thereagainst and are disassemblable into a relatively compact, hand carryable arrangement.

2. A golf practice net apparatus according to claim 1 and characterized further in that said cross-member includes hinge means pivotably connecting said arm portions of said cross-member for relative folding movement.

3. A golf practice net apparatus according to claim 1 and characterized further in that said net is secured to said cross-member along both arm positions thereof.

4. A golf practice net apparatus according to claim 1 and characterized further in that said net connecting and disconnecting means of said support members and said extension members include clip means for securing said net thereto.

5. A golf practice net apparatus according to claim 1 and characterized further in that each said stabilizer member includes a weight means secured adjacent one end thereof to be disposed outwardly from the respective support member when connected thereto.

6. A golf practice net apparatus according to claim 1 and characterized further in that each said stabilizer member is connectible to its respective support member at the foot portion thereof.

7. A golf practice net apparatus according to claim 1 wherein each said leg portion includes a longitudinally extending interior storage cavity, and said disconnectible stabilizer is insertable into the interior storage cavity of its respective support member for storage.

* * * * *

UNITED STATES PATENT AND TRADEMARK OFFICE

CERTIFICATE OF CORRECTION

PATENT NO. : 4,913,439

DATED : April 3, 1990

INVENTOR(S) : Carroll M. Ellington

It is certified that error appears in the above-identified patent and that said Letters Patent is hereby corrected as shown below:

Column 3, Lines 10-11, reads "thereaginst" but should read -- thereagainst --.

Column 8, Line 3, reads "positions" but should read -- portions --.

Signed and Sealed this

Fifteenth Day of September, 1992

*Attest:*

DOUGLAS B. COMER

*Attesting Officer*

*Acting Commissioner of Patents and Trademarks*